United States Patent [19]

Keith

[11] Patent Number: 4,911,254

[45] Date of Patent: Mar. 27, 1990

[54] POLYCRYSTALLINE DIAMOND CUTTING ELEMENT WITH MATING RECESS

[75] Inventor: Carl W. Keith, Spring, Tex.

[73] Assignee: Hughes Tool Company, Houston, Tex.

[21] Appl. No.: 346,924

[22] Filed: May 3, 1989

[51] Int. Cl.[4] ..... E21B 10/46; E21B 10/56

[52] U.S. Cl. ..... 175/329; 51/309; 76/108 A; 175/410; 408/145

[58] Field of Search ..... 175/329, 410, 409, 374, 175/375, 330; 51/309, 307; 76/101 A, 101 R, 108 A, 108 R, DIG. 12; 408/144, 145

[56] References Cited

U.S. PATENT DOCUMENTS

| | | | |
|---|---|---|---|
| 2,994,390 | 8/1961 | Hildebrandt | 175/374 X |
| 4,457,765 | 7/1984 | Wilson | 175/329 X |
| 4,498,549 | 2/1985 | Jürgens | 175/329 |
| 4,515,226 | 5/1985 | Mengel et al. | 175/57 |
| 4,538,690 | 9/1985 | Short, Jr. | 175/329 |
| 4,558,753 | 12/1985 | Barr | 175/329 |
| 4,606,418 | 8/1986 | Thompson | 175/329 |
| 4,624,830 | 11/1986 | Barr | 175/329 X |
| 4,682,663 | 7/1987 | Daly et al. | 175/329 |
| 4,696,354 | 9/1987 | King et al. | 175/329 |
| 4,699,227 | 10/1987 | Wardley | 175/329 |
| 4,767,050 | 8/1988 | Flood et al. | 175/329 X |

OTHER PUBLICATIONS

DeBeers Catalog–Standard PCD Product Range.
Stratapax Publication–Drill Blanks.

*Primary Examiner*—Stephen J. Novosad
*Attorney, Agent, or Firm*—Charles D. Gunter, Jr.

[57] ABSTRACT

A polycrystalline diamond cutting element is shown which includes a mounting body having a leading face and a trailing face and a thin layer of super hard material carried on the leading face of the mounting body which defines a cutting face. The cutting face has a circular outer periphery which is interrupted to form a recess in the cutting face which continues through the mounting body. The recess mates in complementary fashion with the outer periphery of a second cutting element when the cutting elements are arranged side-by-side with the cutting faces thereof in a common plane.

10 Claims, 3 Drawing Sheets

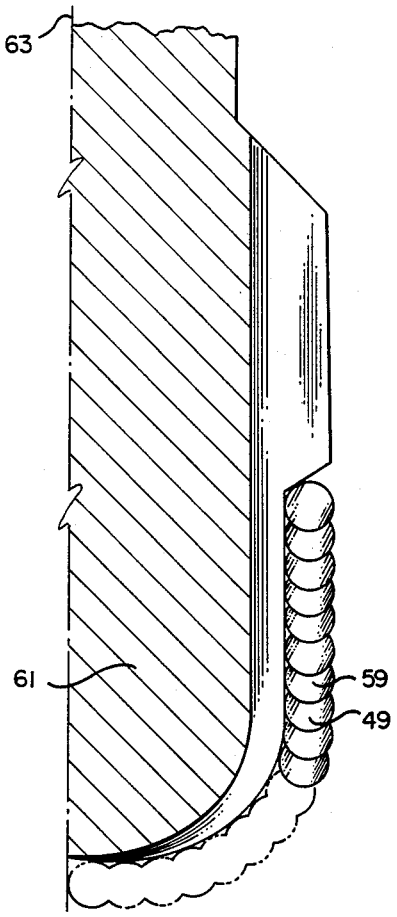
FIG. 2
FIG. 3 PRIOR ART
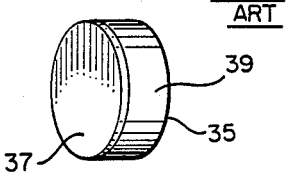
FIG. 4 PRIOR ART
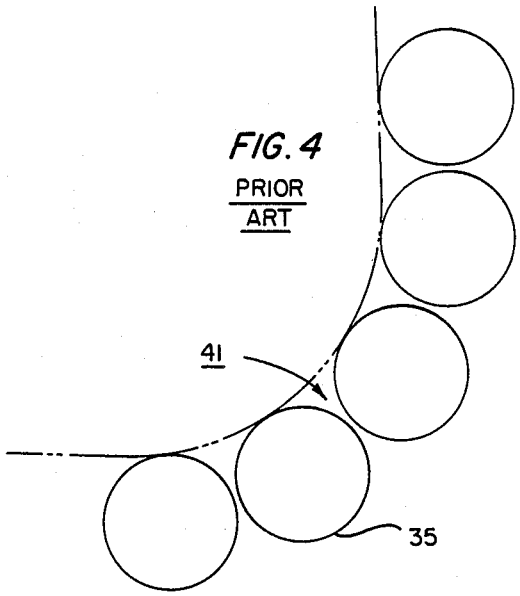
FIG. 5
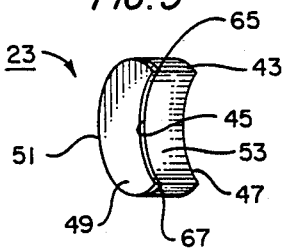
FIG. 6
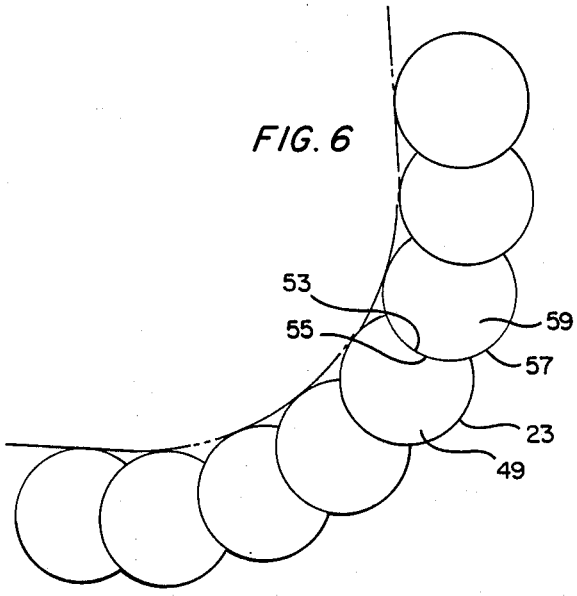

POLYCRYSTALLINE DIAMOND CUTTING ELEMENT WITH MATING RECESS

BACKGROUND OF THE INVENTION

1. Field of the Invention.

The present invention relates to cutting tools of the type utilizing diamond cutting elements and to an improved cutting element with a complementary profile which allows a closer spacing of like cutter elements than previously possible.

2. Description of the Prior Art.

A variety of cutting tools are known which are well suited for receiving diamond cutting elements as the cutting or wear portion of the tool. Such tools are found, for instance, in the mining, construction, and oil and gas exploration and production industries and include earth boring bits, under reamer hole openers, and the like. Commercially available earth boring bits can be generally divided into the rolling cutter bits, having either steel teeth or tungsten carbide inserts, and diamond bits, which utilize either natural diamonds or artificial or man-made diamonds. The artificial diamonds are "polycrystalline", used either individually or as a component of a composite compact or insert on a cemented tungsten carbide substrate. More recently, artificial polycrystalline diamonds have been developed which are stable at higher temperatures than the previously known polycrystalline diamond. Both types of polycrystalline diamond are available in a variety of shapes and sizes.

The diamond earth boring bits can be generally classified as either steel bodied bits or matrix bits. The steel bodied bits are machined from a steel block and typically have cutting elements which are press-fit into openings provided in the bit face. The matrix bit is formed by coating a hollow tubular steel mandrel in a casting mold with metal bonded hard material, such as tungsten carbide. The casting mold is of a configuration which will give a bit of the desired form. The cutting elements are typically either polycrystalline diamond compact cutters braised within an opening provided in the matrix backing or are thermally stable polycrystalline diamond cutters which are cast within recesses provided in the matrix backing.

Cutters are often placed in a straight row extending from a central location on the bit face out to the full bit diameter. Alternatively, cutting elements are set in individual mountings placed strategically around the bit face. With either arrangement, more than one cutting element is typically placed side-by-side on the bit face with the cutting faces of the cutting elements being located in a radial plane from the axis of rotation of the bit. The cutting elements themselves, whether stud mounted or placed within openings in the matrix material have generally been manufactured with circular cutting faces. Because two circular cutting faces places side-by-side in a cutting plane fail to achieve full coverage of that plane, it was generally necessary in the past to provide a staggered cutting arrangement on the bit face with alternate cutter rows achieving full coverage.

Although polycrystalline diamond cutting elements are commercially available as segments of circles, these alternate cutting shapes have not been utilized, to my knowledge, to achieve increased density and hence full coverage of a cutting plane on a diamond bit face. Square cut polycrystalline diamond cutting elements are also known but do not include mating recesses to provide a complementary profile on the bit face to achieve full coverage of a cutting plane with a single blade of cutting elements arranged side-by-side.

The present invention has as its object to provide a polycrystalline diamond cutting element having a mating recess which allows a complementary fit with an adjacent cutter to achieve full coverage of a cutting plane.

Another object of the invention is to provide a method of manufacturing a cutting tool which allows worn diamond cutters to be salvaged and utilized without detracting from the performance characteristics of the cutting tool.

Another object of the invention is to provide a polycrystalline diamond bit with an increased density of cutting elements in a single bit blade.

Another object of the invention is to provide a method for manufacturing polycrystalline diamond cutting elements more economically by cutting a plurality of cutting elements from a single blank, the elements sharing a common boundary.

Additional objects, features and advantages will be apparent in the written description which follows.

SUMMARY OF THE INVENTION

The cutting elements of the invention include a mounting body having a leading face and a trailing face and a relatively thin layer of super hard material carried on the leading face of the mounting body and defining a cutting face for the cutting element. The cutting face has an outer periphery which is interrupted to form a recess in said cutting face which continues through the mounting body. The recess is selectively shaped to mate in complementary fashion with the outer periphery of a second cutting element when the cutting elements are arranged side-by-side with the cutting faces thereof in a common plane on a cutting tool.

Preferably, the cutting elements are crescent shaped having an arcuate recess for mating in complimentary fashion with the generally circular periphery of a next adjacent cutting element.

BRIEF DESCRIPTION OF THE DRAWINGS

FIG. 2 is a partial, sectional view along a radial plane taken from the bit axis of rotation showing the orientation of the cutting elements with respect to the radial plane;

FIG. 3 is a perspective view of a prior art polycrystalline diamond cutting elements;

FIG. 4 is a simplified, schematic view illustrating the placement of the prior art polycrystalline diamond cutting elements on the bit face;

FIG. 5 is a perspective view of the polycrystalline diamond cutting element of the invention;

FIG. 6 is a simplified, schematic view illustrating the placement of the polycrystalline diamond cutting elements of the invention on the bit face;

DETAILED DESCRIPTION OF THE INVENTION

Figure 1:
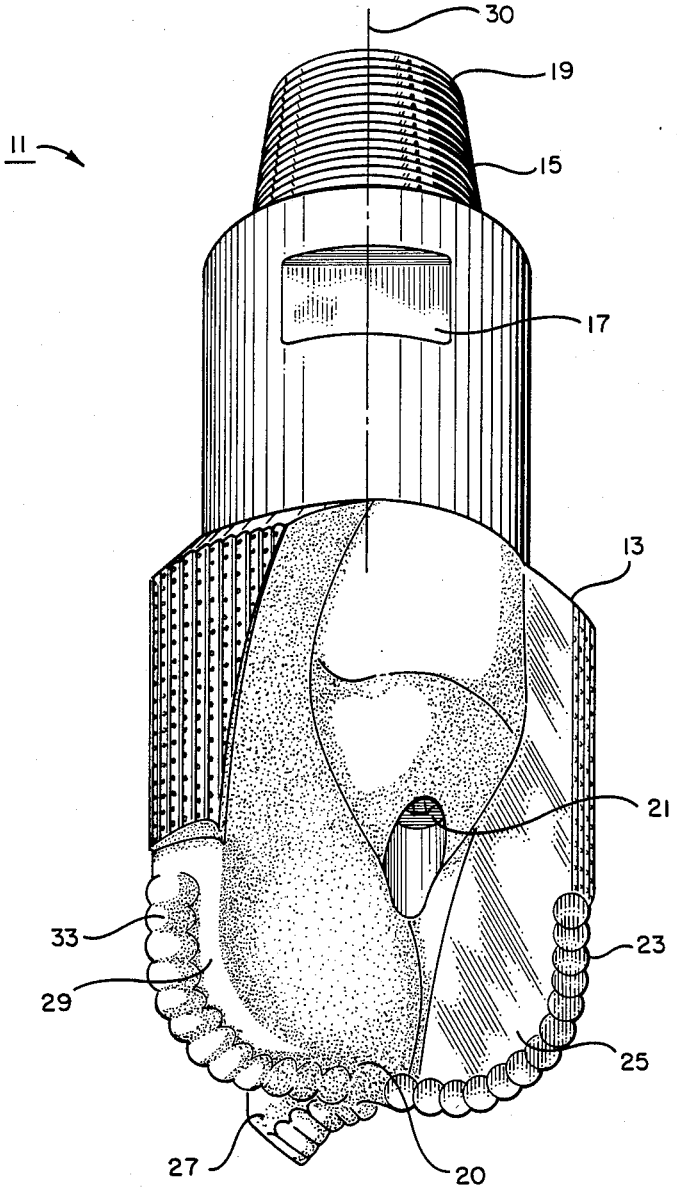
FIG. 1 is a perspective view of a bit of the invention showing the placement of the cutting elements on the bit face.

The cutting elements of the invention are well suited for use in a variety of cutting tools including matrix and steel bodied earth boring bits, under reamer hole opener arms and similar applications where a full diamond cutting edge is desired. The numeral 11 in FIG. 1 shows such an earth boring bit having a body 13 with a threaded shank 15 formed on one end for connection with a drill string member (not shown). The body 13 further includes a pair of wrench flats 17 used to apply the appropriate torque to properly "make-up" the threaded shank 15. The body 13 has a tubular bore 19 which communicates with the interior of the drill string member, and which communicates by internal fluid passageways (not shown) with one or more fluid openings 21 which are used to circulate fluids to the bit face.

On the opposite end of the bit body 13 from the threaded shank 15, there is formed a bit head or "matrix" 20 in a predetermined configuration to include polycrystalline diamond cutting elements 23. The matrix 20 is of a composition of the same type used in conventional diamond matrix bits, one example being that which is disclosed in U.S. Pat. No. 3,175,629, to David S. Rowley, issued Mar. 30, 1965. Such matrices can be, for example, formed of a copper-nickel alloy containing powered tungsten carbide.

Matrix head bits of the type shown in FIG. 1 are manufactured by casting the matrix material in a mold about a steel mandrel. The mold is first fabricated from graphite stock by turning on a lathe and machining a negative of the desired bit profile. Cutter pockets are then milled into the interior of the mold to the proper contours and dressed to define the position and angle of the cutting elements. The internal fluid passageways are formed by positioning a temporary displacement material within the interior of the mold which will later be removed.

A steel mandrel is then inserted into the interior of the mold and the tungsten carbide powders, binders and flux are added to the mold. The steel mandrel acts as a ductile core to which the matrix material adheres during the casting and cooling state. After firing the bit in a furnace, the mold is removed and the cutters are mounted on the exterior bit face within recesses in or receiving pockets of the matrix.

The bit body 13 in FIG. 1 has a plurality of integral blades 25, 27 and 29 formed of the cast matrix material which extend axially in planes parallel to the longitudinal axis 30 of the bit and radially outward to terminate in relatively flat portions. As shown in FIGS. 1 and 2, the blades 25, 27 and 29 have polycrystalline diamond cutting elements 23 mounted therein within backings 33 of the matrix for drilling the earthen formations. The backings 33 for the cutting elements 23 are portions of the matrix which protrude outwardly from the face of the bit and which are formed with cutter receiving pockets or recesses during the casting operation.

Cutting elements of the type under consideration have been provided commercially in a variety of shapes and sizes. Such cutting elements are of a hard material, preferably polycrystalline diamond composite compacts. The cutting elements are formed by sintering a polycrystalline diamond layer to a tungsten carbide substrate and are commercially available to the drilling industry from General Electric Company under the "STRATAPAX" trademark. The previously known cutting elements were generally cylindrical in shape having planar cutting faces, although other cutting elements have been proposed having non-planar cutting faces, for instance convex or concave. FIG. 3 shows a typical prior art composite compact 35 which includes a polycrystalline diamond layer 37 sintered to a tungsten carbide cylindrical substrate 39. These cutting elements were typically mounted in the recesses provided in the matrix by braising the compacts within the recesses. FIG. 4 illustrates a typical cutter placement of a plurality of prior art composite compacts 35 in a "blade" pattern about a bit face. It will be noted in FIG. 4 that spaces 41 exist about the cylindrical cutters placed side-by-side in a single plane "blade" fashion.

FIG. 5 shows the novel polycrystalline diamond cutting element of the invention 23. The cutting element 23 includes a mounting body 43 of tungsten carbide having a leading face 45 and a trailing face 47. A relatively thin layer 49 of super hard material is carried on the leading face 45 of the mounting body 43 and defines a planar cutting face for the cutting element 23. Preferably, the super hard material 49 comprises polycrystalline diamond material. The mounting body 43 is preferably cemented tungsten carbide.

It will be noted that, unlike the prior art composite compact shown in FIG. 3, the cutting element 23 of the invention has an outer periphery 51 which is generally arcuate or circular, and which is interrupted to form a recess 53 in the cutting face which continues through the mounting body. As shown in FIG. 6, the recess 53 of cutting element 23 is shaped to mate in complementary fashion with the outer periphery 55 of a second cutting element 57 when the cutting elements 23, 57 are arranged side-by-side with the planar cutting faces 49, 59 thereof in a common plane on the earth boring bit 11.

As shown in FIG. 5, the recess 53 preferably interrupts the outer periphery 51 of the cutting element at two points 65, 67 to form a crescent shaped recess 53. The sidewall of the recess 53 which connects the two points 65, 67 forms a smoothly sloping arcuate surface which forms a concave recess in the cutting face 49 and mounting body 43. The crescent shaped recess produces a cutting element which, when viewed from the front, appears to have one concave edge and one convex edge.

Figure 8:
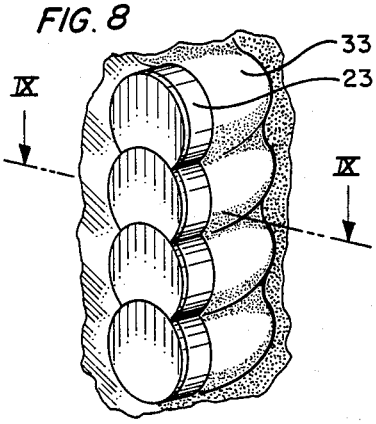
FIG. 8 is an isolated view of a portion of the bit face showing a polycrystalline diamond cutting element of the invention mounted in the matrix material.
Figure 9:
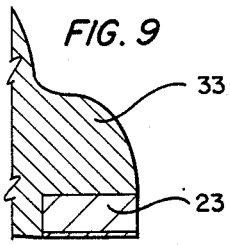
FIG. 9 is a cross-sectional view taken along lines IX—IX in FIG. 8.

FIG. 8 shows a group of four cutting elements 23 of the invention mounted on the face of a matrix bit. The backings 33 for the cutting elements 23 are portions of the matrix formed with cutter receiving recesses. FIG. 9 is a partial sectional view, taken along lines IX—IX in FIG. 8 further illustrating the matrix backing 33.

Figure 10:
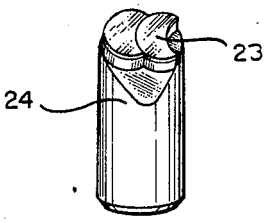
FIG. 10 is a view of a pair of polycrystalline diamond cutting elements of the invention mounted to a carrier stud.

FIG. 10 shows multiple cutting elements 13 of the invention brazed to a tungsten carbide carrier stud 24. As will be familiar to those skilled in the art, the carrier studs 24 are typically press-fit into openings provided in the bit face of a steel bodied bit.

As shown in FIG. 2, the cutting faces 49, 59 are located in a radial plane 61 from the axis of rotation 63 of the bit 11. It will be noted that the cutting elements 23, 57 of the invention can be spaced more closely than the prior art cutting elements 35 to achieve full coverage of a cutting plane at any projected angle. In other words, the mating recesses 53 of the cutting elements of the invention mate against adjacent cutters to form a virtually continuous polycrystalline diamond cutting blade of infinitely variable shape. Cutters can be placed on a single plane 61 side-by-side around any profile configuration and achieve full coverage of that plane at any projected angle.

Figure 7:
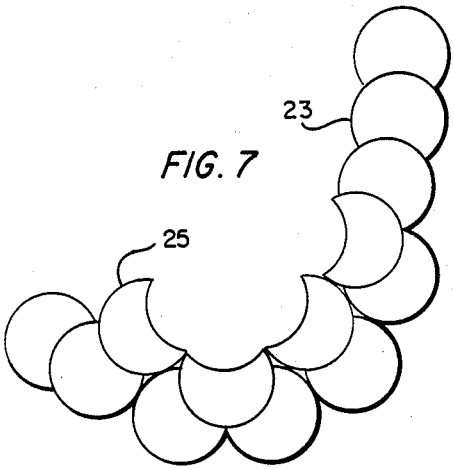
FIG. 7 is a simplified, schematic view illustrating another arrangement of the polycrystalline diamond cutting elements of the invention.

The cutting elements of the invention can be placed in a variety of configurations on the bit face. For instance, FIG. 7 shows a ballistic shaped row of cutting elements 23 having a second row of cutting elements 25 spaced apart therefrom to achieve increased cutter density.

Figure 11:
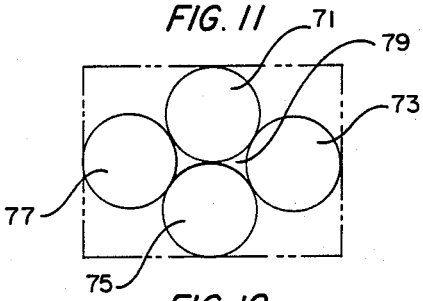
FIG. 11 is a view of a circular template representing the relative amount of diamond material used to manufacture a plurality of prior art cutting elements.
Figure 12:
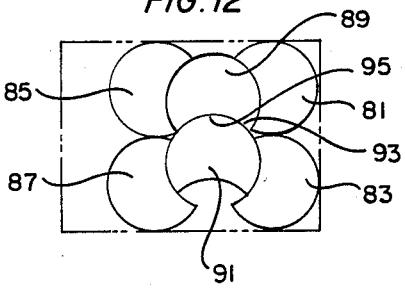
FIG. 12 is a view of a circular template showing a plurality of cutting elements of the invention which have been cut from a minimum amount of material.

FIG. 11 shows a prior art blank of polycrystalline diamond material from which individual cutting elements 71, 73, 75 and 77 are cut. It will be noticed that a certain amount of material 79 is wasted. FIG. 12 shows a similar blank of polycrystalline diamond material from which a plurality of cutting elements 81, 83, 85, 87, 89 and 91 of the invention are cut. Two advantages result from this manufacturing technique. First, there is less wasted material 79. Also, the cutting tool must be capable of cutting extremely hard materials. Wire EDM cutters are known in the art for this purpose. However, the cutting operation is time consuming. It will be noted that the outer periphery 93 of one cutting element 91 is also the inner recess 95 of the next adjacent cutting element 89. Since the peripheral edges of two separate cutting elements are being formed simultaneously, there is a savings in cutting time.

An invention has been provided with several advantages. The mating recess of the novel cutting elements of the invention allow closer spacing of the cutting elements to achieve full coverage of a cutting plane at any projected angle. The crescent shaped "interlocking" feature of the cutting elements allows adjacent cutters to be mated to form a virtually continuous cutting blade. It is not necessary to have staggered alternating rows of cutters to achieve a continuous cutting plane. Because a portion of the prior art cylindrical cutting face is missing in the cutting elements of the invention, worn cutters can sometimes be salvaged by providing the recess in the area of the cutting face which was damaged. By cutting mating cutting elements from a single blank a savings in cutting time and material can be achieved.

While the invention has been shown in only one of its forms, it is not thus limited but is susceptible to various changes and modifications without departing from the spirit thereof.

I claim:

1. A polycrystalline diamond cutting element with mating recess for use on a cutting tool, comprising:

a mounting body having a leading face and a trailing face and a relatively thin layer of super hard material carried on said leading face of said mounting body and defining a cutting face for said cutting element;

wherein said cutting face has an outer periphery which is interrupted to form a recess in said cutting face which continues through the mounting body, and wherein said recess is shaped to mate in complementary fashion with the outer periphery of a second cutting element when the cutting elements are arranged side-by-side with the cutting faces thereof in a common plane on said cutting tool.

2. The cutting element of claim 1, wherein said mounting bodies comprise cemented tungsten carbide.

3. The cutting element of claim 2, wherein said super hard material comprises polycrystalline diamond material.

4. A polycrystalline diamond cutting element with mating recess, the cutting element being adapted for use on the body of an earth boring bit, comprising:

a mounting body having a leading face and a trailing face and a relatively thin layer of super hard material carried on said leading face of said mounting body and defining a planar cutting face for said cutting element;

wherein said cutting face has an outer circular periphery which is interrupted at two points to form a recess in said cutting face which continues through the mounting body, and wherein said recess is shaped to mate in complementary fashion with the outer cylindrical periphery of a second cutting element when the cutting elements are arranged side-by-side with the cutting faces in a common plane on said earth boring bit, whereby a plurality of mating cutting elements can be closely spaced to form a continuous blade on the bit body.

5. The cutting element of claim 4, wherein said two points on said outer cylindrical periphery of each of said cutting faces are connected in a smoothly sloping arcuate surface which forms a concave recess in said mounting bodies.

6. A polycrystalline diamond cutting element adapted to provide increased density of cutting elements on the body of an earth boring bit, comprising:

a mounting body having a leading face and a trailing face and a relatively thin layer of super hard material carried on said leading face of said mounting body and defining a cutting face for said cutting element, said cutting face having a recess therein which forms a crescent-shaped profile for said cutting element.

7. A bit for use in drilling earthen formations, comprising:

a body including a bit face on one end and a shank on the opposite end with means for connection to a drill string for rotation about a longitudinal axis;

a plurality of cutting elements mounted on said bit body and extending through said bit face, said cutting elements having cutting faces adapted to engage an earth formation and cut the earth formation to a desired three dimensional profile, each of said cutting elements comprising a mounting body having a leading face and a trailing face and a relatively thin layer of super hard material carried on said lending face of said mounting body and defining a cutting face for said cutting elements, said cutting face having a recess therein which forms a crescent-shaped profile for said cutting element.

8. A bit for use in drilling earthen formations, comprising:

a body including a bit face on one end and a shank on the opposite end with means for connection to a drill string for rotation about a longitudinal axis;

a plurality of cutting elements mounted on said bit body and extending through said bit face, said cutting elements having cutting faces adapted to engage an earth formation and cut the earth formation to a desired three dimensional profile, each of said cutting elements comprising a mounting body having a leading face and a relatively thin layer of super hard material carried on said leading face and defining said cutting face;and wherein each cutting face has an outer cylindrical periphery which is interrupted at two points to form a recess in said cutting face which continues through the mounting body, and wherein said recess is shaped to mate in complementary fashion with the outer cylindrical periphery of a next adjacent cutting element when the cutting elements are arranged side-by-side with the cutting faces in a common plane on said earth boring bit, whereby a plurality of mating cutting elements can be closely spaced to form a continuous blade on the bit body.

9. The bit of claim 8, wherein said bit body is formed of cast matrix material and wherein said mounting bodies for said cutting elements are received within recesses provided in said cast matrix material.

10. The bit of claim 8, wherein said mounting bodies are mounted on a carrier stud which is, in turn, mounted in a recess provided in said bit face.

* * * * *